US006784147B1

(12) United States Patent
Smith et al.

(10) Patent No.: US 6,784,147 B1
(45) Date of Patent: Aug. 31, 2004

(54) SOY BASED DRAIN CLEANER

(75) Inventors: David John Smith, Amherst, OH (US); Joseph A. Tomaro, Maple Heights, OH (US); Tammy G. Westerman, Bratenahl, OH (US)

(73) Assignee: State Industrial Products, Cleveland, OH (US)

( * ) Notice: Subject to any disclaimer, the term of this patent is extended or adjusted under 35 U.S.C. 154(b) by 0 days.

(21) Appl. No.: 10/612,510

(22) Filed: Jul. 3, 2003

(51) Int. Cl.[7] ..... C11D 1/00

(52) U.S. Cl. ..... 510/195; 510/421; 510/505; 510/563; 134/42

(58) Field of Search ..... 510/195, 421, 510/463, 505; 134/42

(56) References Cited

U.S. PATENT DOCUMENTS

| | | | | | |
|---|---|---|---|---|---|
| 6,096,699 | A | * | 8/2000 | Bergemann et al. | 510/201 |
| 6,191,087 | B1 | * | 2/2001 | Opre et al. | 510/201 |
| 2004/0033919 | A1 | * | 2/2004 | Ruhr et al. | 510/218 |

* cited by examiner

*Primary Examiner*—Necholus Ogden
(74) *Attorney, Agent, or Firm*—Lightbody & Lucas

(57) ABSTRACT

A drain cleaner with soy methyl ester (SME) CAS #66784-80-9 utilized at 92.8% by weight, the emulsifier system composed of combination of lauramide DEA and secondary alcohol ethoxylate CAS #'s 120-40-1 and 68131-40-8 utilized at 7% and a butylated hydroxytoluene CAS #128-37-1 used as an anti-oxidant at 0.2%.

14 Claims, No Drawings

SOY BASED DRAIN CLEANER

FIELD TO WHICH THE INVENTION RELATES

This invention relates to a soy based drain cleaner. One embodiment of this cleaner includes soy methyl ester (SME) (92% by weight preferred), a combination of lauramide DEA and secondary alcohol ethoxylate as an emulsifier (3 and 4% by weight respectively preferred) and butylated hydroxytoluene as an anti-oxidant (0–1% by weight preferred).

BACKGROUND OF THE INVENTION

The present application relates to a drain cleaner.

Drain cleaners have the reputation of being harsh. This reputation is respected by the maintenance individuals using them to clean drains. It is also respected by individuals having incidental contacts thereafter. Examples of the latter include other maintenance personnel, the general public using the facilities, downstream water treatment systems and together with animals and fish inhabiting the water shed. In addition to toxicity, possible subsequent interactions with other chemicals, both naturally occurring and man made, are also considered.

OBJECTS OF THE INVENTION

It is an object of this invention to provide for a naturally derived solvent drain cleaner.

It is another object of this invention to provide for a low toxicity drain cleaner.

It is a further object of this invention to provide biodegradability to drain cleaners.

It is still a further object of this invention to increase the flash point of drain cleaners.

It is yet another object of this invention to lower the odor of drain cleaners.

Other objects and a further understanding of the invention may be had by referring to the detailed description of the invention.

DETAILED DESCRIPTION OF THE INVENTION

In accord with the presently preferred embodiment of the invention, a new product of a relatively stable homogenous liquid composition for cleaning drains is provided. The present invention is a formula based on a soy solvent in combination with an emulsifier system and anti-oxidant. The formula provides a drain cleaner to dissolve unwanted substances. Examples include grease and fats in drain systems, septic tanks and garbage disposals.

The use of the soy based solvent in a cleaner is an alternative to more conventional solvents such as dichlorobenzene, d-limonene, petroleum distillates or blends of citrus terpenes and petroleum hydrocarbons which have been previously used. While a number of these conventional solvents are efficient, they have a higher toxicity and volatility than the soy based solvent set forth herein. This toxicity and volatility inherently restricts the number and types of areas/systems that may be successfully cleaned re: the soy solvent herein disclosed. Further, the soy based solvent is biodegradable with a low aquatic toxicity. It is also capable of being readily decomposed by biological means (especially bacterial action). This allows for the use of the soy solvent in conventional drains both for their cleaning and disposing of the soy solvent; there are no special environmental restrictions on its use. Why some conventional solvents (such as citrus terpenes) may share some of the properties of the soy solvent, other attributes (such as a lower flash point and higher volatility) reduce the type and number of applications for such solvents. For example, the soy solvent has a high flash point (greater than 300° F.) compared to other solvents (for example 120° for citrus solvents). This allows for the soy solvent's use in kitchens and industrial settings and environments having sparks and open flame. The soy solvent also has very low fumes and odors (distinctly less than for example citrus solvents). The soy solvent thus is desirable for use around people in such areas as food handling (where a competitive drain cleaner having higher odor levels is not).

In the particular preferred embodiment of the drain cleaner, soy methyl ester (SME) CAS #67784-80-9 is utilized at 92% by weight, the emulsifier system composed of a combination of lauramide DEA and secondary alcohol ethoxylate CAS #'s 120-40-1 and 68131-40-8 is utilized at 3 and 4% by weight respectively and a butylated hydroxytoluene CAS #128-37-1 is used as an anti-oxidant at 1% by weight. Methyl soyate CAS #67762-38-3 could be substituted for the soy methyl ester (SME) if desired.

This soy based solvent can be diluted in water to spread its efficacy over a larger area. This same hydroporosity allows it to be cleaned up and rinsed off with water or soap and water with no remaining residue. It can also be used as an additive to the other cleaners and degreasers.

The soy base provides the solvent component for the formula. This base dissolves the grease and fats in the drain system. It is naturally derived and readily decomposed by the biology of drain systems (especially by the bacteria present therein). Further it has a low toxicity and odor, thus making it more amenable to a greater number of applications than alternative solvents currently in use (such as citrus terpenes and/or petroleum distillates). The soy base is present from 80–98% by weight (92% preferred).

Other materials that will meet the criteria for the solvent (but which may or may not be as desirable for a given application) include:

General classes of methylated vegetable oils.

General classes of plant oils modified by transesterifying the triglyceride oils with a mono-functional acid, example Methyl Cottonseed from Norman, Fox & Co.

Canola oil and derivatives. Example Canola Gold 110 from AG Environmental Products.

Castor oil.

Acetate esters of long chain alcohols (example: Exxate$^R$ solvents from Exxon).

Alcohols C6 and above are preferred because they are less odorous.

Lactate esters—Ethyl lactate from Purlac and Vertec. Cetyl lactate (Cerphyl 28 from International Specialty Products).

Esters of medium/long chain fatty acids and medium/long chain alcohols (example: Octyl Stearate from Croda, Inc.) and others in Crodamol series.

Dibasic ester solvents (example: Dupont's DBE series and the Dermol series from Alzo International).

Esters of short chain, mono-functional organic acids and glycerin (example: Estol$^R$ 1579 (Glycerol Triacetate)).

Free fatty acids, C-12 and higher.

The emulsifiers allow for the homogeneous suspension of the very finely divided oily or residence liquid in the solvent.

This allows the drain cleaner to dissolve or go into suspension in another liquid such as the water present in drain systems. This is desirable for the finely divided oily, resinous soy methyl ester (SME) disclosed. Typical emulsifiers are surfactants or combinations of surfactants. The emulsifiers are present from 2–20% by weight in the disclosed drain cleaner.

In the preferred embodiment, the emulsifier is a linear alcohol ethoxylate surfactant. The emulsifier is important as it permits the product to be mixed with water for certain applications. Note, however, there are some situations where one would want to leave out the emulsifier. This would allow the soy solvent to float on the surface of the water rather than emulsifying in it. Examples of this type of situation are lift stations and sewage ejection pits.

Two surfactants that are used in the embodiment of the invention disclosed include an alkanolamide (DeMile MLY-100 from DeForest 3% by weight) and an alcohol ethoxylate (Tergitol 15-S-9 from Dow Chemical 4% by weight). Both are non-ionic surfactants. Other classes of non-ionic surfactants that could be used include:

Alkanol Amines, Ethoxylated Alkylphenols, Ethyoxylated Alkyl Amides, Ethyoxylated Fatty esters and Oils and Phosphate esters. In addition, various polar surfactants will also work. Examples include Dipolar surfactants, derivatives of alkylated pyrrolidone (example: Surfadone LP series from ISP). Anionic surfactants, such as Calimulse PRS, isopropyl amine dodecylbenzene sulfonic acid from Pilot Chemical. Cationic surfactants, such as Tomah E-14-5, ethoxylated alkyl amine.

The main criteria are that the surfactant has enough aliphatic character to be completely soluble in soy methyl ester (SME) forming a clear solution. That also means that the surfactant contains the minimum amount of water (10% at most preferred).

The anti-oxidant is provided to slow down the oxidation of the soy solvents. It thus helps to check the deterioration and degradation of the formula. The anti-oxidant is preferably from 0–1% by weight in the formula.

The anti-oxidant ingredient of the preferred embodiment is an anti-oxidant, CAO-3 from PMC Specialties at 1% by weight. This is butylated hydroxytoluene (BHT); 4-methyl-2; 6-di-t-butyl-phenol, CAS #128-37-0. Other anti-oxidants that could be used include:

Vitamin E, Erythorbic Acid, 2, 5-di-butyl-hydroquinone, mono-methyl-hydroquinone (MEQH), secondary organophasphates and hydroquinone.

There are a number of low toxicity food grade alternative anti-oxidants which could be also utilized with the invention.

Note, however, that the drain cleaner remains capable of being readily decomposed by biological means, especially by bacterial action. This facilitates the low toxicity of the drain cleaner.

The soy based solvent in the preferred embodiment is methyl soyate or soy methyl ester (SME), preferably from 80–90% of the total composition. This soy based solvent is joined with an emulsifier system from 2–20% and an anti-oxidant (from 0.05 to 1%).

Although the invention is described in its preferred embodiment with a certain degree of particularity, it is realized that numerous changes may be made without deviating from the invention. For example, ingredients such as coloring and thickeners can be added to the soy based drain cleaner to provide for product differentiation and new properties respectively.

What is claimed is:

1. A soy based cleaner for drains comprising from 92% by weight of at least one of soy methyl ester (SME) or methyl soyate, together with from 7% by weight of a non-ionic or a polar emulsifier and from 1% by weight of an anti-oxidant.

2. The drain cleaner of claim 1 characterized in that soy methyl ester (SME) is utilized as the soy.

3. The drain cleaner of claim 1 characterized in that methyl soyate is utilized as the soy.

4. The drain cleaner of claim 1 characterized in that the emulsifier is a non-ionic surfactant.

5. The drain cleaner of claim 1 characterized by the addition of a non-active ingredient.

6. The drain cleaner of claim 5 characterized in that the non-active ingredient is a colorant.

7. A soy based drain cleaner comprising soy methyl ester (SME) at 92% by weight, an emulsifier of a combination of lauramide DEA at 3% by weight and secondary alcohol ethoxylate at 4% by weight and a butylated hydroxytoluene as an anti-oxidant at 1% by weight.

8. A method for cleaning drains comprising assembling a soy based drain cleaner having from 92% by weight of at least one of soy methyl ester (SME) or methyl soyate, together with from 7% by weight of a non-ionic or a polar emulsifier and from 1% by weight of an anti-oxidant, and using the soy based cleaner to clean drains.

9. The method of using the drain cleaner of claim 8 characterized in that soy methyl ester (SME) is utilized as the soy.

10. The method of using the drain cleaner of claim 8 characterized in that methyl soyate is utilized as the soy.

11. The method of using the drain cleaner of claim 8 characterized in that the emulsifier is a non-ionic surfactant.

12. The method of using the drain cleaner of claim 8 characterized by the addition of a non-active ingredient.

13. The method of using the drain cleaner of claim 12 characterized in that the non-active ingredient is a colorant.

14. A method for cleaning drains comprising having a soy based drain cleaner comprising soy methyl ester (SME) at 92% by weight, an emulsifier of a combination of lauramide DEA at 3% by weight and secondary alcohol ethoxylate at 4% by weight and a butylated hydroxytoluene as an anti-oxidant at 1% by weight, and using the soy based cleaner for cleaning drains.

* * * * *